US005613177A

United States Patent [19]

Meetze, Jr. et al.

[11] Patent Number: 5,613,177

[45] Date of Patent: Mar. 18, 1997

[54] CLEAN FINNED TONER CARTRIDGE

[75] Inventors: Murray O. Meetze, Jr., Rochester; Rhonda L. Staudt, Webster; Timothy G. Struczewski, Rochester, all of N.Y.

[73] Assignee: Xerox Corporation, Stamford, Conn.

[21] Appl. No.: 585,074

[22] Filed: Jan. 11, 1996

[51] Int. Cl.[6] ..... G03G 15/06

[52] U.S. Cl. ..... 399/263; 399/262

[58] Field of Search ..... 355/260; 222/DIG. 1

[56] References Cited

U.S. PATENT DOCUMENTS

| | | | |
|---|---|---|---|
| 3,604,599 | 9/1971 | Richmond | 222/DIG. 1 |
| 3,973,699 | 8/1976 | Cook | 222/DIG. 1 X |
| 4,203,533 | 5/1980 | Zeuthen | 222/DIG. 1 X |
| 4,611,730 | 9/1986 | Ikesue et al. | 222/167 |
| 4,641,945 | 2/1987 | Ikesue et al. | 355/3 DD |
| 4,739,907 | 4/1988 | Gallant | 222/240 |
| 4,744,493 | 5/1988 | Ikesue et al. | 222/167 |
| 4,819,578 | 4/1989 | Koiso et al. | 118/652 |
| 4,878,603 | 11/1989 | Ikesue et al. | 222/167 |
| 4,965,639 | 10/1990 | Manno et al. | 355/260 |
| 5,053,825 | 10/1991 | Trainor et al. | 355/260 |
| 5,057,872 | 10/1991 | Saijo et al. | 355/260 |
| 5,074,342 | 12/1991 | Kraehn | 222/DIG. 1 X |
| 5,109,254 | 4/1992 | Oka et al. | 355/260 |
| 5,121,168 | 6/1992 | Aoki et al. | 355/298 |
| 5,435,461 | 7/1995 | Smith et al. | 222/DIG. 1 X |
| 5,455,662 | 10/1995 | Ichikawa et al. | 355/260 |
| 5,495,323 | 2/1996 | Meetze, Jr. | 355/260 |
| 5,508,794 | 4/1996 | Ikesue et al. | 355/260 |

*Primary Examiner*—Nestor R. Ramirez
*Attorney, Agent, or Firm*—John S. Wagley

[57] ABSTRACT

A device is provided for storing a supply of particles for use in a developer unit of an electrophotographic printing machine. The device includes an open ended container which has a chamber in communication with the open end of the container. The particles are stored in the chamber of the container. The device also includes a feature associated with the container which extends substantially the length of the container, for urging the marking particles in the chamber toward the center of the chamber.

26 Claims, 7 Drawing Sheets

CLEAN FINNED TONER CARTRIDGE

The present invention relates to a developer apparatus for electrophotographic printing. More specifically, the invention relates to a cartridge for dispensing toner.

Cross reference is made to the following applications filed concurrently herewith: U.S. Application Ser. No. 08/534,024 filed Jan. 11, 1996, entitled "Toner Cartridge Internal Plug", by Rhonda L. Staudt et el. and U.S. Application Ser. No. 08/584,421 filed Jan. 11, 1996, entitled "Dry Toner Cartridge Breather Cap ", by John D. Sundquist et al.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable marking particles typically in the form of a powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey developer material to the latent image at a controlled rate so that the developer material effectively adheres electrostatically to the charged areas on the latent image. A commonly used technique for development is the use of a two-component developer material, which comprises, in addition to the toner particles which are intended to adhere to the photoreceptor, a quantity of magnetic carrier granules or beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll."

Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll.

In an electrophotographic printer as the toner within the developer material is transferred to the photoreceptor and eventually to the copy paper, this used toner must be replaced. The electrophotographic printer thus includes a toner container or cartridge from which fresh toner is dispensed into the machine. When using two component developer, a portion of the carrier granules will eventually deteriorate. Additional new carrier granules may be added to the machine to replace the deteriorated granules. The toner container or cartridge may thus alternatively store a mixture including a small quantity of carrier granules in addition to the toner. To provide for a small compact toner cartridge and to provide for a toner cartridge in which the opening to the cartridge may be easily removed, the toner cartridge typically has a compact shape with a small opening from which the toner is dispensed.

Traditionally when all the toner within the container had been consumed, additional toner was supplied to the machine by pouring toner from a separate refilling bottle into the container. This method permitted many toner particles to become airborne during filling and enter the machine. The operator may even miss the opening of the container during filling and spill large quantities of toner inside the machine. Since the toner is inherently very susceptible to electrostatic charges, the toner sticks electrostatically to all the remote recesses of the machine making cleaning of the machine necessary, time consuming, and expensive.

Recently, machines have been supplied with replaceable toner containers or cartridges to avoid some of the problems associated with spilling toner during refilling. While missing the opening of the container during filling and spilling large quantities of toner is alleviated by replaceable toner containers, spillage can occur from the old container during removal and from the new container during installation.

Toner in the toner container or cartridge must be fed therefrom to the latent image to effectuate development. Typically, toner containers are located with their openings in the bottom of the container whereby they may be emptied by gravity. In attempts to make inexpensive and compact electrophotographic printers and to minimize space and related costs, however, the shape of the toner container may not be conducive to a bottom opening or to an unassisted emptying of the container. When the opening is not in the bottom or the geometry of the container does not promote the free flow of all the contents, a mechanism must be provided for removing the toner therefrom. While the demand for toner remains fairly constant, these mechanisms expel large quantities of toner when the container is full and progressively smaller amounts as the container empties.

Cylindrical toner containers are now available with spiral ribs located in the internal periphery thereof, which when rotated urge the toner to the end thereof. These containers have an opening in the periphery of the container near one end thereof through which toner escapes. A machine interface which must be sealed to the container is used to remove toner from the opening. The risk of dirty surfaces at the opening and the interface and the risk of spilling the toner if the container is tipped during installation remain with these containers. These containers, furthermore, are long and slender and may not be compatible with the space available in the development unit. An example of a prior art container is shown in U.S. patent application Ser. No. 08/202,616 to Meetze, incorporated herein by reference. The space constraint is a particular problem for color toner containers that contain only small volumes of toner.

The following disclosures may be relevant to various aspects of the present invention:

U.S. Pat. No. 5,455,662

Patentee: Ichakawa et el.

Issue Date: Oct. 3, 1995

U.S. Pat. No. 5,121,168

Patentee: Aoki et al.

Issue Date: Jun. 9, 1992

U.S. Pat. No. 5,057,872

Patentee: Saijo et al.

Issue Date: Oct. 15, 1991

U.S. Pat. No. 4,965,639

Patentee: Manno et al.

Issue Date: Oct. 23, 1990

U.S. Pat. No. 4,878,603

Patentee: Ikesue et al.

Issue Date: Nov. 7, 1989

U.S. Pat. No. 4,819,578

Patentee: Koiso et al.

Issue Date: Apr. 11, 1989

U.S. Pat. No. 4,744,493

Patentee: Ikesue et al.

Issue Date: May 17, 1988

U.S. Pat. No. 4,739,907

Patentee: Gallant

Issue Date: Apr. 26, 1988

U.S. Pat. No. 4,641,945

Patentee: Ikesue et al.

Issue Date: Feb. 10, 1987

U.S. Pat. No. 4,611,730

Patentee: Ikesue et al.

Issue Date: Sep. 16, 1986

U.S. Patent Application No. 08/202,616

Applicant: Meetze

Filing Date: Feb. 28, 1994

The relevant portions of the foregoing disclosures may be briefly summarized as follows:

U.S. Pat. No. 5,455,662 discloses a developer replenishing device for replenishing a developing device with a developer and a developer container for use therewith. The developer container or toner bottle has a mouth portion at one end thereof which is smaller than in diameter than a hollow cylindrical main body. At the end of the bottle provided with the mouth, a shoulder has the inner periphery thereof partly raised to the edge of the mouth portion to form a raised portion for scooping up toner.

U.S. Pat. No. 5,121,168 discloses an image forming apparatus for developing a latent image on a photosensitive body. The latent image is developed by a developing device and is transferred onto a sheet of paper and remaining toner on the photosensitive body is removed therefrom by a cleaner. The image forming apparatus has a used toner storing portion for collecting the removed remaining toner thereinto and integral with the developing container.

U.S. Pat. No. 5,057,872 discloses a developer supplying device which includes a substantially cylindrical developer container having on its peripheral surface a spiral groove and being able to rotate to transport a developer therein by the groove. The device includes a supplying element in the form of an opening and a regulating device.

U.S. Pat. No. 4,965,639 discloses a reproduction machine having a rotatable toner supply cartridge which dispenses toner into a developer sump. The cartridge is inclined at an angle with respect to the horizontal axis so as to dispense toner. The dispensing is assisted by gravity in controlled amounts only from the end of the cartridge extending beneath the horizontal.

U.S. Pat. No. 4,878,603 discloses a toner replenishing device for replenishing toner to a toner storage area, from where the toner is supplied to a developing section. The device includes a holder for releaseably holding a cartridge containing therein a quantity of toner. The holder may be located at a cartridge mounting and dismounting position and at a replenishing position. The cartridge is held substantially horizontally and driven to rotate thereby discharging the toner to a toner transporting path leading to the toner storage area. The cartridge is provided with a first mating member and the holder is provided with a second mating member corresponding in position and receiving the first mating member.

U.S. Pat. No. 4,819,578 discloses a toner collecting device for collecting residual toner removed from an image retainer by a cleaning device after a toner image formed on the image retainer has been transferred to a sheet of paper. The toner collecting device has therein a conveyor device for carrying the residual toner. The conveyor device has its leading end portion disposed at a central portion of the toner collecting device. The upper surface of the toner collecting device has functions to guide transfer paper and to support a transfer electrode, and the leading end portion of the conveyor device is provided with a toner distributing diffusion blade member.

U.S. Pat. No. 4,744,493 discloses a toner replenishing device for replenishing toner to a toner storage area, from where the toner is supplied to a developing section. The device includes a holder for releaseably holding a cartridge containing therein a quantity of toner. The holder may be located at a cartridge mounting and dismounting position and at a replenishing position. The cartridge is held substantially horizontally and driven to rotate thereby discharging the toner to a toner transporting path leading to the toner storage area. The cartridge is provided with a first mating member and the holder is provided with a second mating member corresponding in position to the first mating member. Thus, only the cartridge having the first mating member may be properly held by the holder for carrying out a toner replenishing operation.

U.S. Pat. No. 4,739,907 discloses a cylindrical developer storage and dispensing cartridge with a dispensing opening at one end. The cartridge has an integral developer transport mixing and anti-bridging member rotatably supported within the container which has a first coiled spring element having a cross section substantially the same as the cross section of the container and freely rotatable therein. The first element is wound in the direction to transport developer along its length toward the dispensing opening and a second coiled spring element having a cross section substantially smaller than the first spring element, but being substantially concentrically positioned and being attached to the first element but wound in an opposite direction.

U.S. Pat. No. 4,641,945 discloses a toner supply device for supplying a developing unit of an electrophotographic copier with a toner developer which is stored in a cylindrical cartridge. The cartridge is fixed in a horizontal position in the vicinity of the developing unit of the copier while occupying a minimum of space. The toner supply device is desirably applicable to a small-size electrophotographic copier.

U.S. Pat. No. 4,611,730 discloses a toner replenishing device for replenishing toner to a toner storage area, from where the toner is supplied to a developing section. The device includes a holder for releaseably holding a cartridge containing therein a quantity of toner. The holder may be located at a cartridge mounting and dismounting position and at a replenishing position. The cartridge is held substantially horizontally and driven to rotate thereby discharging the toner to a toner transporting path leading to the toner storage area. The cartridge is provided with a first mating member and the holder is provided with a second mating member corresponding in position to the first mating member. Thus, only the cartridge having the first mating member may be properly held by the holder for carrying out a toner replenishing operation.

U.S. Ser. No. 08/202,616 discloses a device for storing a supply of particles for use in a developer unit of an electrophotographic printing machine. The device comprises an open ended container defining a chamber in communication with the open end thereof. The particles are stored in the chamber of the container. The device further comprises a puncturable seal attached to the open end of the container for sealing the chamber. The container is installable into the developer unit without removal of the seal.

According to the present invention, there is provided a device for storing a supply of particles for use in a developer unit of an electrophotographic printing machine. The device includes an open ended container which has a chamber in communication with the open end of the container. The particles are stored in the chamber of the container. The device also includes a feature associated with the container which extends substantially the length of the container, for urging the marking particles in the chamber toward the center of the chamber.

According to the present invention, there is also provided a developer unit for developing a latent image recorded on an image receiving member with a supply of particles. The developer unit includes an open ended container having a chamber in communication with the open end of the container. The particles are stored in the chamber of the container. The developer unit also includes a feature, associated with the container, for urging the marking particles in the chamber toward the center of the chamber. The developer unit also includes a feed mechanism extending through the open end into the center of the container for feeding a controllable amount of particles from the chamber of the container.

According to the present invention, there is further provided an electrophotographic copy machine for developing with a supply of particles a latent image recorded on an image receiving member. The copy machine including a developer unit. The developer unit includes an open ended container having a chamber in communication with the open end of the container. The particles are stored in the chamber of the container. The developer unit also includes a feature, associated with the container, for urging the marking particles in the chamber toward the center of the chamber. The developer unit also includes a feed mechanism extending through the open end into the center of the container for feeding a controllable amount of particles from the chamber of the container.

IN THE DRAWINGS

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 2 printing machine will be shown hereinafter schematically and their operation described briefly with reference thereto.

Figure 2:
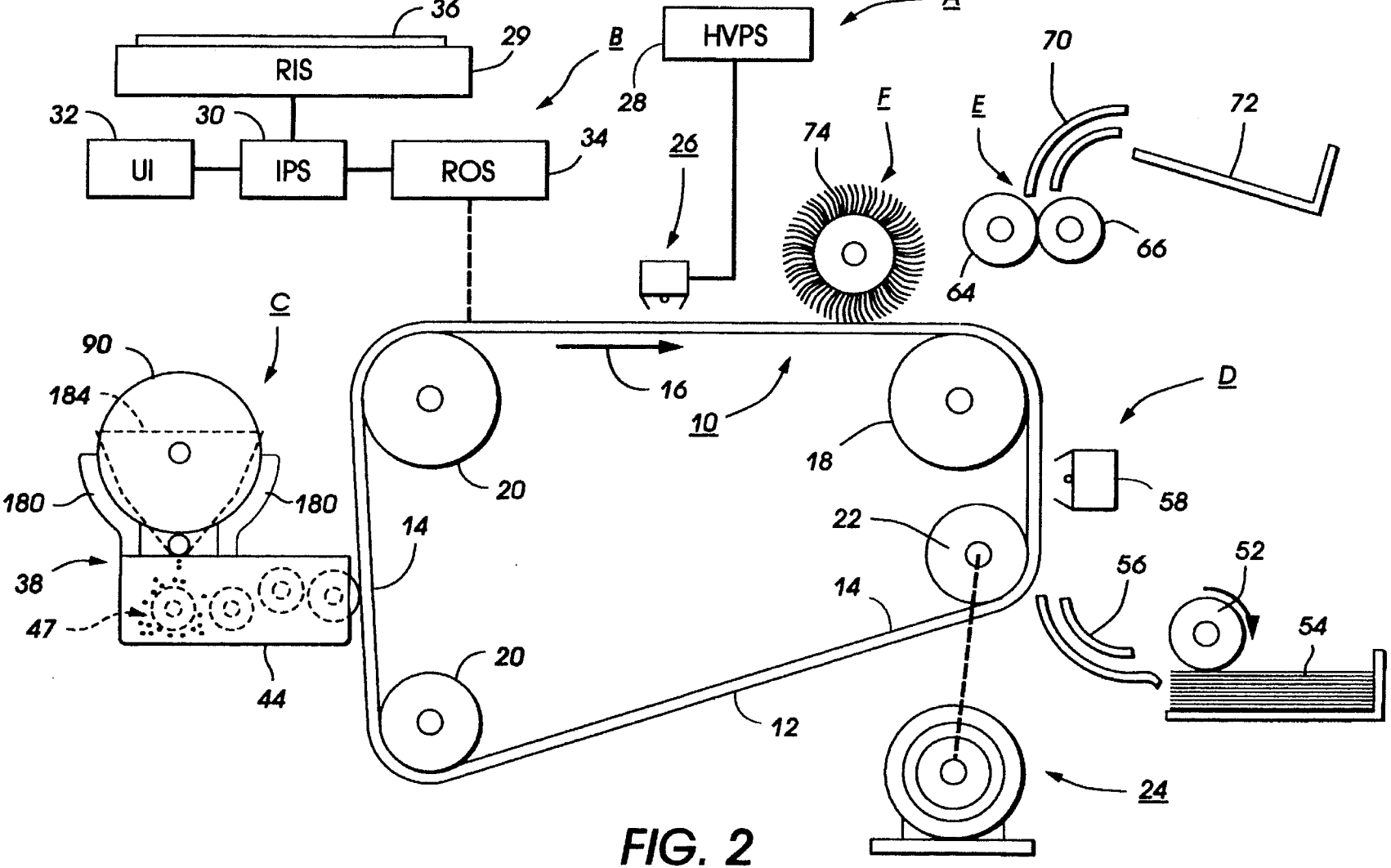
FIG. 2 is a schematic elevational view of an illustrative electrophotographic printing machine incorporating the development apparatus of FIG. 1.

Referring initially to FIG. 2, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to generator 26.

Next, the charged portion of photoconductive surface 12 is advanced through exposure station B. At exposure station B, an original document 36 is positioned on a raster input scanner (RIS), indicated generally by the reference numeral 29. The RIS contains document illumination lamps, optics, a mechanical scanning drive, and a charge coupled device (CCD array). The RIS captures the entire original document and converts it to a series of raster scan lines and (for color printing) measures a set of primary color densities, i.e., red, green and blue densities at each point of the original document. This information is transmitted to an image processing system (IPS), indicated generally by the reference numeral 30. IPS 30 is the control electronics which prepare and manage the image data flow to raster output scanner (ROS), indicated generally by the reference numeral 34. A user interface (UI), indicated generally by the reference numeral 32, is in communication with the IPS. The UI enables the operator to control the various operator adjustable functions. The output signal from the UI is transmitted to IPS 30. The signal corresponding to the desired image is transmitted from IPS 30 to ROS 34, which creates the output copy image. ROS 34 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 2. At development station C, a development system 38, develops the latent image recorded on the photoconductive surface. The chamber in developer housing 44 stores a supply of developer material 47. The developer material may be a two component developer material of at least magnetic carrier granules having toner particles adhering triboelectrically thereto. It should be appreciated that the developer material may likewise comprise a one component developer material consisting primarily of toner particles.

Again referring to FIG. 2, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions onto the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
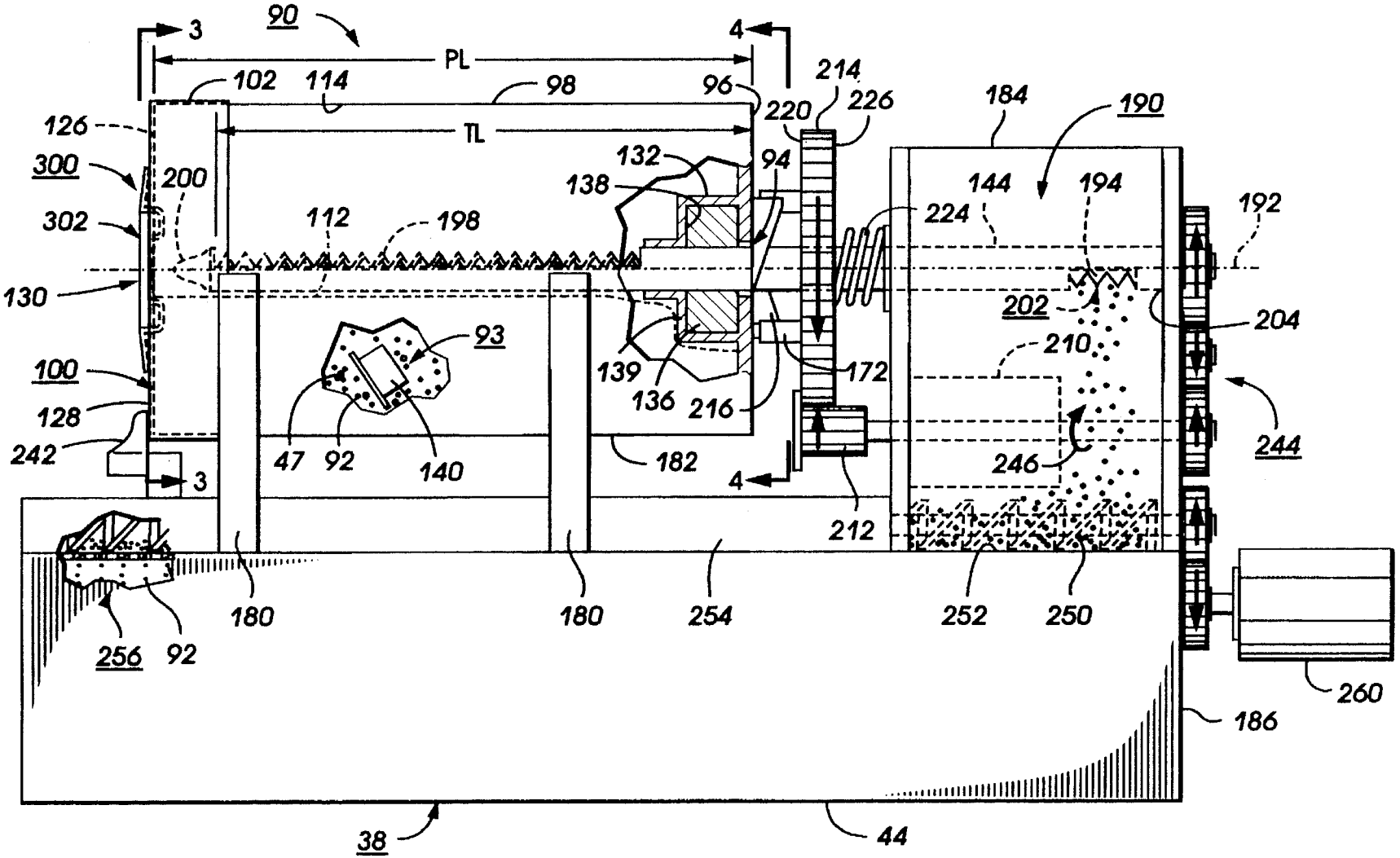
FIG. 1 is a plan view showing the development apparatus of the present invention.

According to the present invention, and referring to FIG. 1, marking particle container 90, is used to store a supply of marking particles 92 within chamber 93 of container 90. The marking particles 92 are typically in the form of an electrostatically attractable powder known as toner. In two component development the development material 47 includes carrier granules (not shown) in addition to the marking particles 92. In "trickle development" as disclosed in U.S. Pat. No. 4,614,165, incorporated herein by reference, a small quantity of carrier granules in addition to the toner particles are added to the toner container to replace the damaged carrier granules. The container 90 may contain a small quantity of carrier granules (not shown) in addition to the toner particles 92. Marking particle container 90 has a generally cylindrical shape and an opening 94 located on a first end 96 of the marking particle container 90. Preferably, the marking particle container 90 includes a first generally cylindrically shaped portion 98 having an open end 100 opposite the opening 94 and cap portion 102 proximate the open end 100 of the cylindrically shaped portion 98. The cylindrical shaped portion 98 and the cap portion 102 are typically separately molded from a plastic, for example, polypropylene. The cylindrical shaped portion 98 and the cap portion 102 are secured together by any suitable means, for example, by welding or by adhesives.

Figure 4:
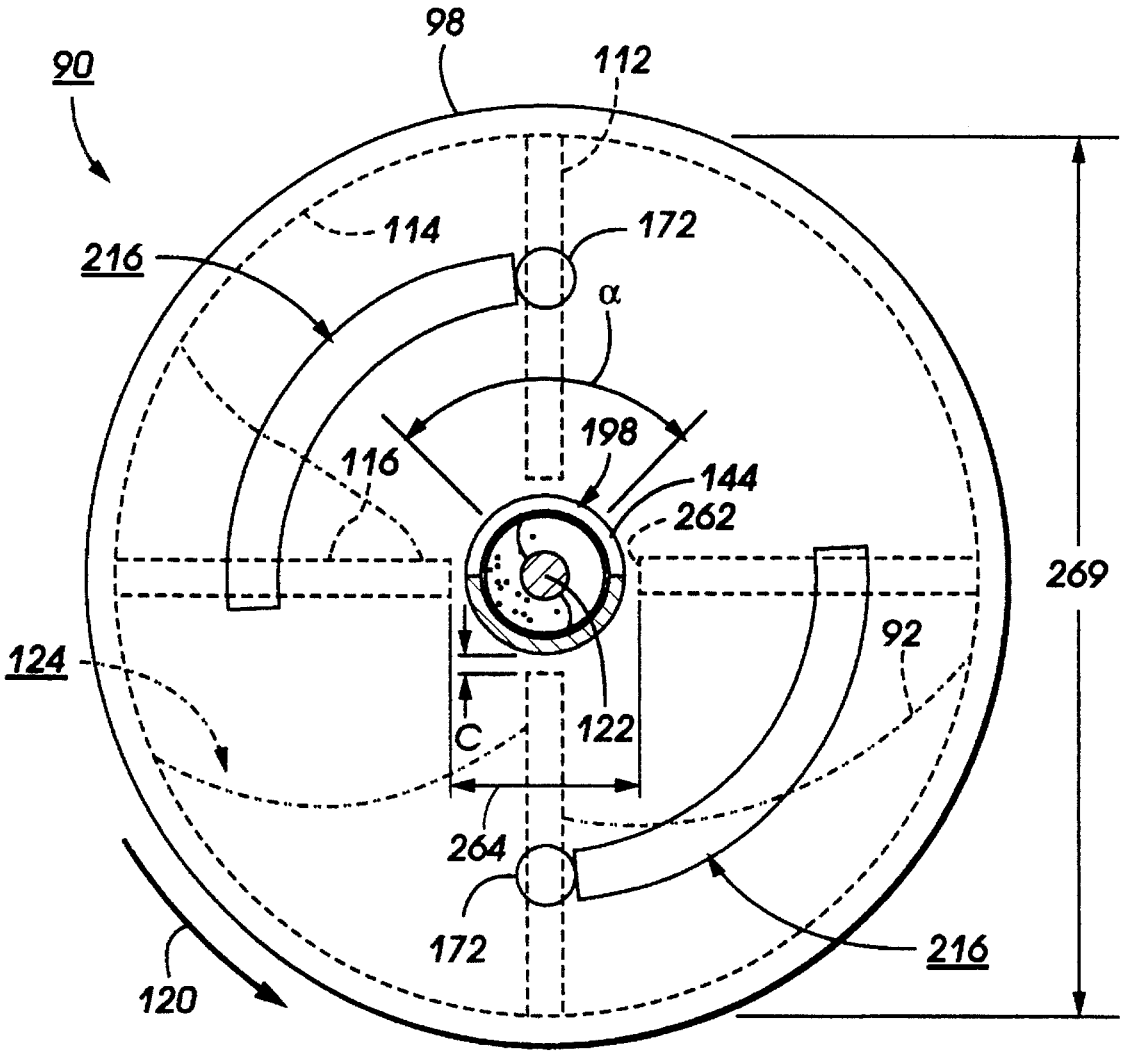
FIG. 4 is a partial plan view along the line 4—4 in the direction of the arrows of the FIG. 1 development apparatus.

Referring now to FIG. 4, the cylindrical shaped portion 98 preferably includes radial protrusions 112 which extend inwardly from inner periphery 114 of the cylindrical shaped portion 98.

Preferably, the radial protrusions 112 have a carrying face 116 which extends inwardly toward centerline 122 of the container 90. Alternatively, the carrying face 116 may curve (not shown) in the direction of rotation 120 of the container 90. The radial protrusions 112 thereby form pockets 124 along the carrying face 116. These pockets 124 become filled with the marking particles 92 and carry the particles 92 along the inner periphery 114 of the container 90. While it should be appreciated that as few as one protrusion may be used, the applicants have found that four equally spaced protrusions are effective.

Referring again to FIG. 1, the cap portion 102 extends from a second face 126 of the cylindrical shaped portion 98. The cap portion 102 includes second end 128 of the container 90 as well as second opening 130 of the container 90.

The cylindrical shaped portion 98 preferably includes an interior hub 132 which extends inwardly from the first end 96 of container 90. A puncturable seal 136 is preferably located against face 138 of shoulder 139 of the interior hub 132 and is contained within the interior hub 132. The seal 136 serves to contain the marking particles 92 during installation, dispensing and removal of the marking particle container 90. The puncturable seal 136 will be described in more detail later. To provide sealing in addition to the puncturable seal 136 when the container 90 is being transported and when in storage, a secondary seal 140 is preferably located in the interior hub 132 spaced outwardly from and parallel to the puncturable seal 136. It should be appreciated that the interior hub 132 may be either a separate component or an integral part of container 90.

The container 90 further includes ramps 216 extending outwardly from first end 96 of the container 90. The ramps 216 are used to interconnect with the development system 38. The marking particle container 90 is shown installed in development system 38. Preferably, the marking particle container 90 is installed with centerline 122 of the marking particle container 90 in a horizontal direction. The marking particle container 90 is supported by bottle supports 180. While a plurality of bottle supports 180 is shown in FIG. 1, it can well be appreciated that one wider bottle support may serve equally as well. Exterior surface 182 of the marking particle container 90 contacts the bottle supports 180 and is supported thereby.

The development system 38 includes the developer housing 44 from which the bottle supports 180 extend. A sump housing 184 extends upwardly from one end 186 of the developer housing 44. A feed mechanism 190 extends through the sump housing 184 and outwardly therefrom in the direction of centerline 192. The feed mechanism 190 extends through opening 94 of the marking particle container 90, centerline 192 being co-linear with centerline 122. Preferably, the feed mechanism 190 is in the form of an auger 194 which is located within tube 144. The tube 144 preferably has an inlet opening 198 in the upper portion of the tube 144 near a first end 200 of the tube 144. The tube 144 also has an outlet opening 202 in the bottom portion of the tube 144 near second end 204 of the tube 144. The development system 38 further includes a container drive motor 210 which may be located anywhere within the development system 38, but preferably, is secured to the sump housing 184. The container drive motor 210 serves to rotate the marking particle container 90 as well as auger 194. It should be appreciated, however, that the invention may be practiced with a separate motor for the auger 194 and a separate motor for the marking particle container 90. Any suitable gear train may be used to connect the motor 210 to the auger 194 and to the marking particle container 90. For example, the motor 210 may have a pinion gear 212 extending inwardly therefrom. A sun gear 214 slidably rotates about tube 144 and meshes with pinion gear 212.

To urge the sun gear 214 against the container 90 and assure the mating of the ramps 216 with pins 172, preferably, the development system 38 further includes a spring 224 slidably fitted about tube 144 between the sump housing 184 and second face 226 of the sun gear 214. To interconnect the marking particle container 90 to the feed mechanism 190, the pins 172 are located on the a face 220 of the sun gear 214 and are aligned adjacent the ramps 216 of the container 90 to cooperate therewith.

Figure 3:
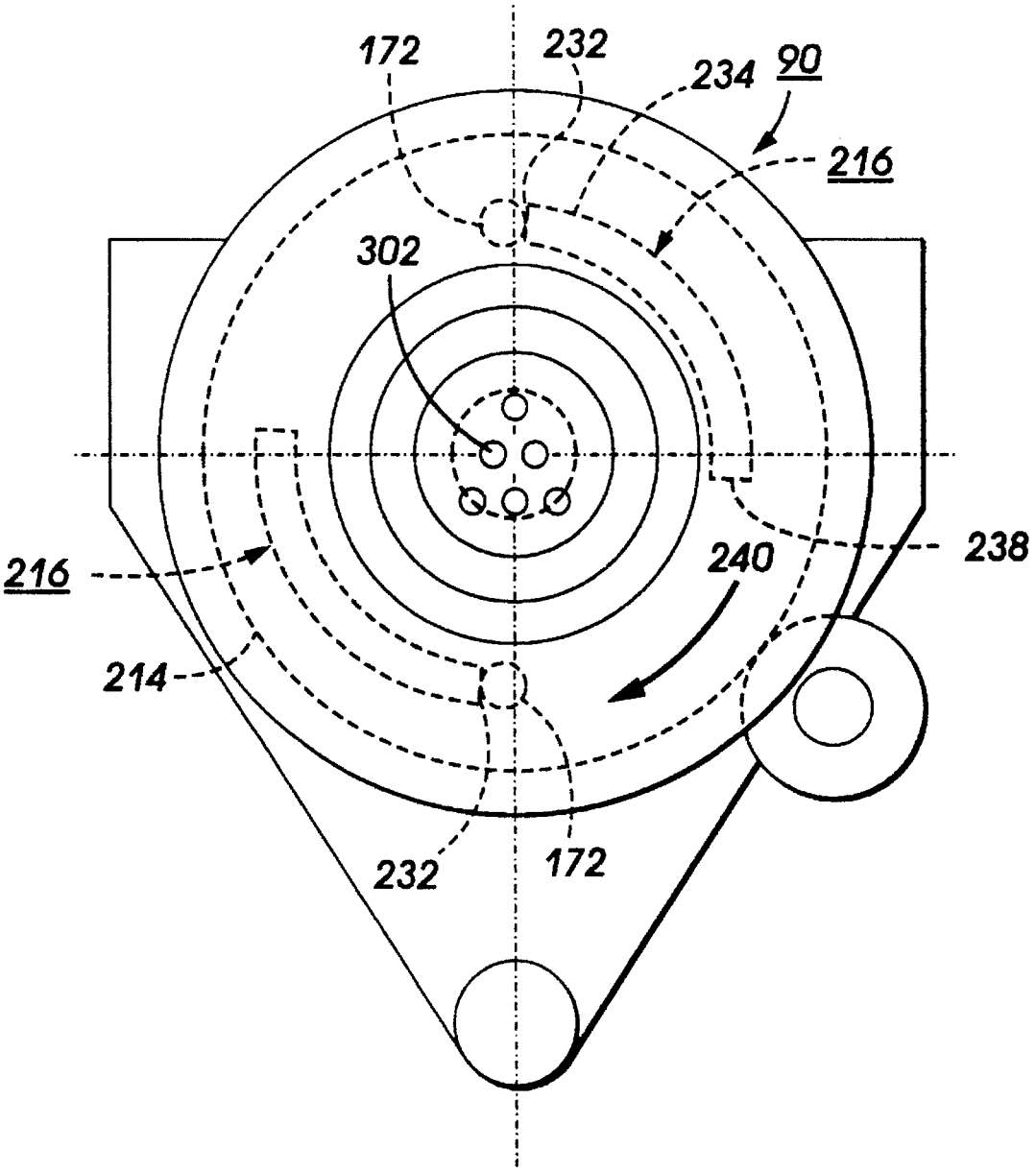
FIG. 3 is a partial sectional view along the line 3—3 in the direction of the arras of the FIG. 1 development apparatus.

Now referring to FIG. 3, the ramps 216 are shown in greater detail. While any drive mechanism to interconnect the sun gear 214 to the marking container 90 may be utilized, the configuration shown in FIG. 4 provides for easy installation of the container 90. The ramps 216 preferably have an arcuate shape with a face 232 on a first end 234 of the stop. The ramps 216 become progressively thinner further from the first end 234 and blend with the first end 96 of container 90 at a second end 238 of the ramp 216. When utilizing the pins 172, the sun gear 214 rotates in a counterclockwise direction 240 until the pins 172 contact the face 232 of the ramps 216 on the container 90. The container 90 then also rotates in the direction of arrow 240, the container 90 being driven by the sun gear 214 at face 232.

Referring again to FIG. 1, to assure that the container 90 is adequately axially positioned relative to the feed mechanism 190, a stop 242 located preferably on developer housing 44 secures the marking particle container by restraining cap portion 102 of the marking particle container 90. A series of gears 244 preferably interconnect drive motor 210 to the auger 194. The gears 244 are so configured that when motor 210 rotates in the direction of arrow 246, the auger 194 will be rotated in a direction to urge the marking particles 92 from the inlet opening 198 to the outlet opening 202.

The development system 38 further preferably includes a developer auger 250 extending from bottom 252 of the sump housing 184. The auger 250 extends outwardly along the length of developer housing 44. The auger 250 is located within conduit 254. The conduit 254 includes one or more dump holes 256 which permit the marking particles 92 to enter the developer housing 44. While the development auger 250 may be driven by motor 210, preferably, the auger 250 is driven by a developer auger motor 260 in order to independently control the flow of developer material 92 from the sump housing 184 to the developer housing 44.

Now referring to FIG. 4, the cylindrical shaped portion 98 of the marking particle container 90 is shown in greater detail. The protrusions 112 extend inwardly from inner periphery 114 of the cylindrical shaped portion 98 to an inner face 262 of the protrusions 112. Preferably, the position of the inner face 262 is defined by diameter 264 located about centerline 122 of the container 90. While as shown in FIG. 4, the protrusions are flat, it should be appreciated that the protrusions 112 may be arcuate or bent to trap a greater quantity of toner particles 92. In order that the pockets 124 carry sufficient toner particles, the protrusions 112 extend to within a small clearance C of the tube 144. Applicants have found that a clearance of approximately 1.5 millimeters is sufficient. The inlet opening 198 of the tube 144 is defined by radial angle $\alpha$. The amount of marking materials 92 that may be carried by pockets 124 is effected by diameter 269 of the inner periphery 114, by the diameter 264 of the protrusions 112, as well as by the radial angle a. Radial angle a also effects the amount of toner particles 92 that may be transported through the tube 144. Preferably the radial angle a is an acute angle of approximately 82°. The diameters 264 and 269 and the angle o should thus be selected to provide an adequate amount of marking particles 92 to be carried by the pockets 124 and through the tube 144.

Again referring to FIG. 1, in order that virtually all the toner particles are lifted around periphery 114 of the container 90, the protrusions 112 extend for most of the length of the container. For example the protrusions 112 extend a length PL from first end 96 of the container 90 to open end 100 of cylindrical shaped portion 98.

In order that virtually all the toner particles are removed by the auger 194, the auger 194 and auger tube 144 extend for most of the length of the container 90. For example the protrusions 112 extend a length TL from first end 96 of the container 90 to open end 100 of cylindrical shaped portion 98.

The puncturable seal 136 and the secondary seal 140 are shown with the container 90 installed into the development system 38. The end 200 of the auger tube 144 first pierces the puncturable seal 136. The puncturable seal 136 remains in a closely conforming position to the auger tube 144 as the tube passes through the seal 136, thereby preventing the spilling of toner particles 92 during installation and removal of the container 90. The seal 136 further provides sealing during the operation of the development system 38. The excess central portion of the seal 136 is displaced inwardly against the tube 144. The tip of the tube 144 displaces the secondary seal 140 out of the interior hub 132 and into the interior of the container 90.

Figure 5:
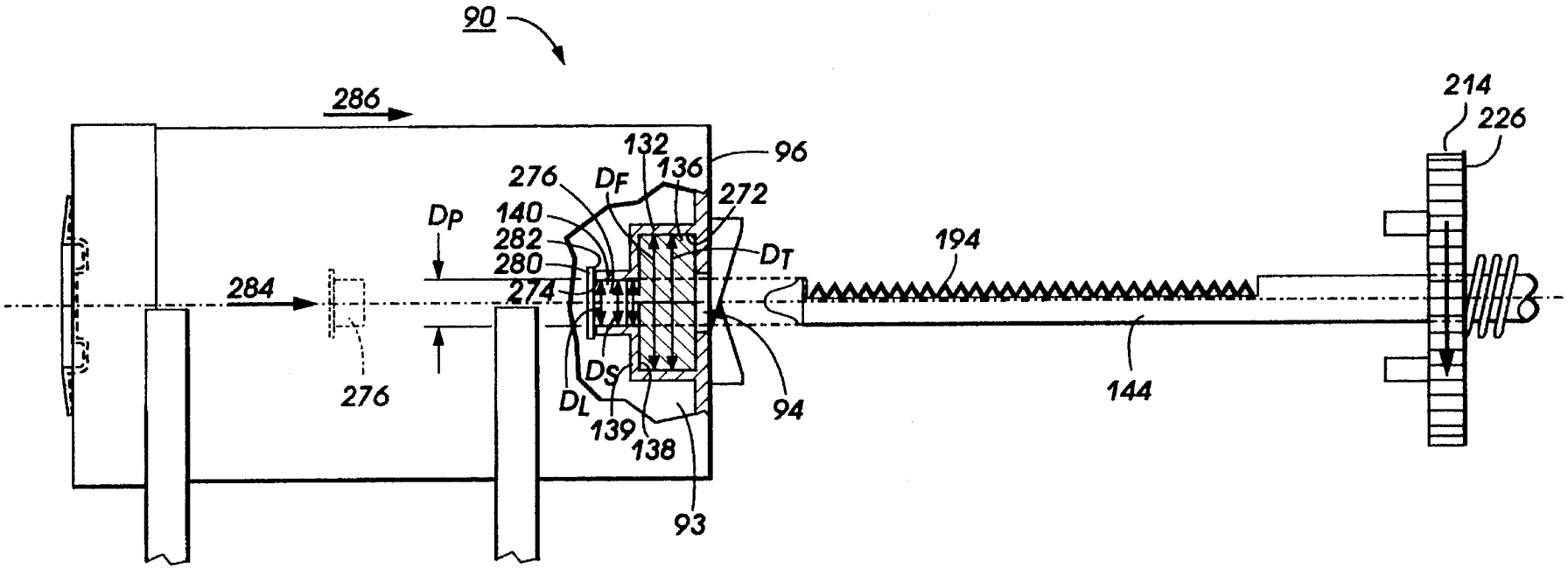
FIG. 5 is a partial plan view of the development apparatus of FIG. 1 showing the toner bottle being installed into the development apparatus.

Referring now to FIG. 5, toner container 90 is shown about to be installed into auger tube 144. As earlier stated the toner container 90 includes internal hub 132 which is preferably molded therewith. The internal hub 132 extends centrally and inwardly from first end 96 of the container 90. The internal hub 132 forms a large bore 272 adjacent the first end 96 of the container 90. The large bore 272 is bounded on its interior by shoulder 139. Extending inwardly from shoulder 139 is small bore 274. Large bore 272 has a diameter Df while small bore 274 has a diameter $D_p$. The puncturable seal 136 is matingly fitted within large bore 272. The puncturable seal 136 has a diameter Dr which is approximately equal to $D_f$ of the large bore 272.

Located internal to the puncturable seal 136 is the secondary seal 140. The secondary seal 140 is in the form of a removable seal or internal plug. The internal plug includes a body 276 and a lip 280 secured to a first end 282 of body 276. The internal seal 140 is installed into small bore 274 of the container 90 by pushing the plug 140 with the body 276 pointing outwardly in the direction of arrow 284 with the plug oriented as shown in phantom. The container 90 is installed into the auger 194 by pushing the container 90 in the direction of arrow 286. Referring again to FIG. 1, the container 90 is shown installed into the auger 194 and the plug 140 is shown trapped within the container 90.

Figure 6:
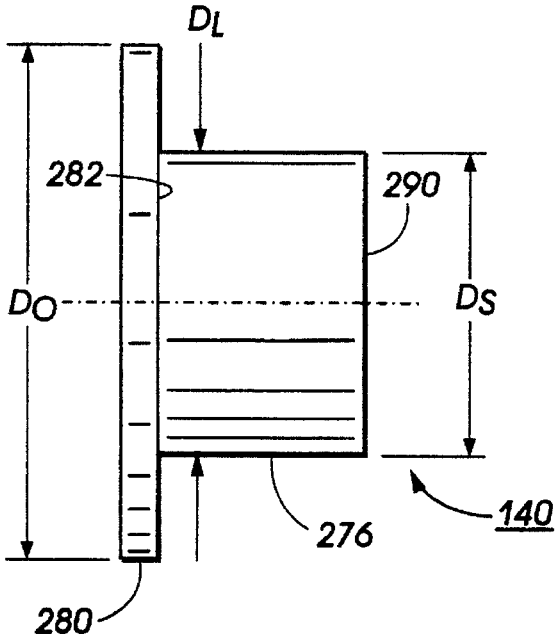
FIG. 6 is a plan view of an internal plug for plugging the toner bottle of the development apparatus of FIG. 1.

Referring now to FIG. 6, the internal plug 140 is shown in greater detail. The body 276 of the internal plug 140 is preferably tapered. The body 276 thus has a diameter DL adjacent the lip 280 which is larger than diameter Ds of the body at second end 290 of the body 276. The lip 280 has a diameter Do which is larger than the diameter DL of the body 276. The lip 280 prevents the plug 140 from being pushed out of the small bore 274 during installation of the internal plug 140 (see FIG. 5). The internal plug 140 maybe any suitable, durable, commercially available plug. For example, the plug 140 may be a commercially available Niagara plastic model #XP-46 internal plug available from Niagara Plastics Company, Erie, Pa.

Figure 7:
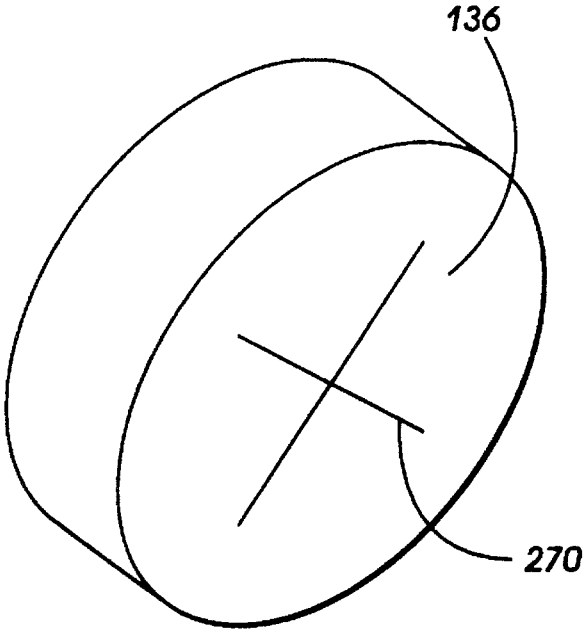
FIG. 7 is a perspective view of a puncturable seal for sealing the toner bottle of the development apparatus of FIG. 1.

The puncturable seal 136 is shown in more detail in FIG. 7. Cross-cuts 270 are preferably added to the seal 136 to permit the entry of the auger tube 144 into the seal 136 without tearing the seal and to permit the seal 136 to closely conform to the auger tube 144 (see FIG. 5). The seal 136 may be made of any suitable material which is easily pierced and very resilient and preferably is made from a compressible material such as a resilient foam plastic, i.e., a polyurethane foam.

Referring again to FIG. 1, the toner container 90 preferably includes an air permeable cover 300 covering an aperture 302 in the container 90. The cover 300 permits air to enter the chamber 93 of the container 90 to avoid the accumulation of a vacuum within the chamber 93 as the toner particles 92 are removed from within the container 90.

For simplicity, and to provide for a ready access for filling the toner container 90 during its manufacture, the aperture 302 is preferably centrally located on the cap portion 102 of the container 90. The aperture 302 thus provides a central opening during manufacturing for completely filling the toner container 90 with toner 92.

Figure 8:
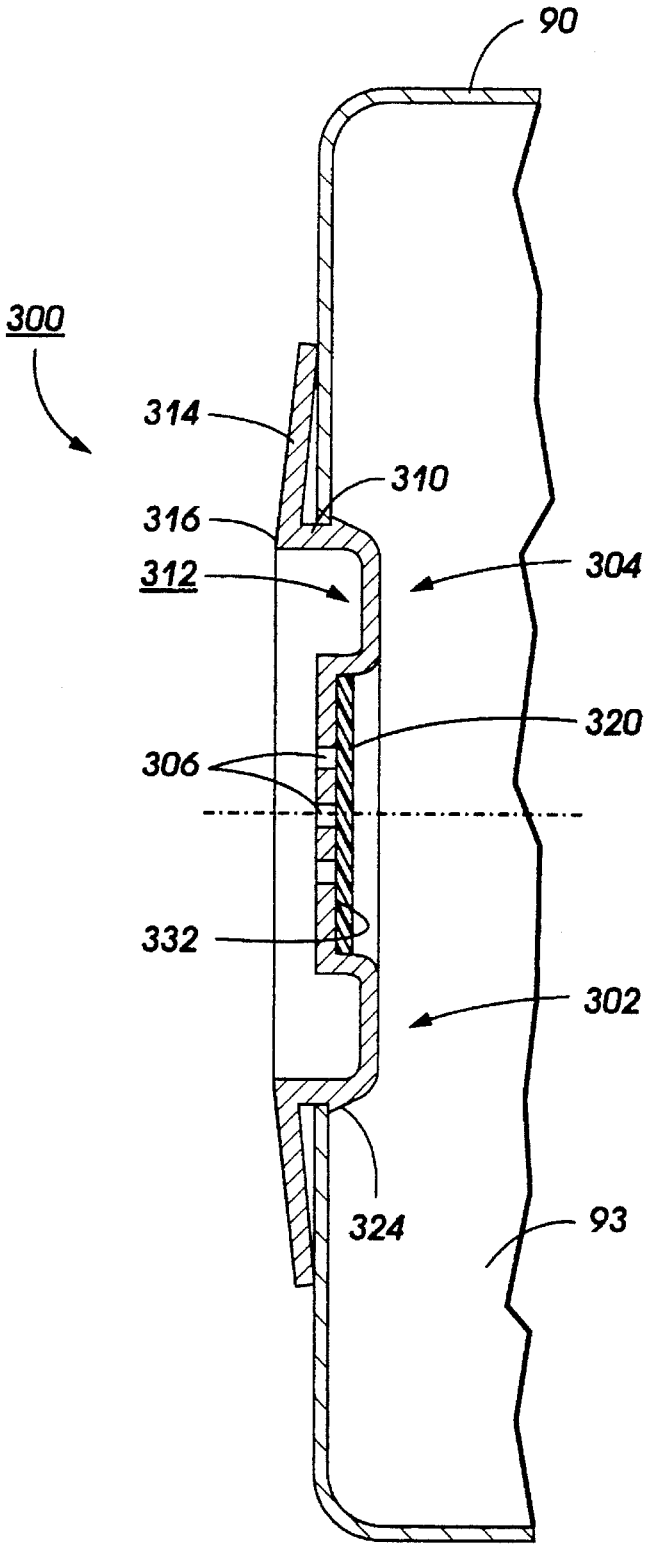
FIG. 8 is a plan view,shown in section, of a breather cap for the toner bottle of the development apparatus of FIG. 1.

The cover 300 is shown in greater detail in FIG. 8. The cover 300 may have any suitable shape and be made of any suitable material. For example, the cover 300 may include a body 304 which includes a central opening 306. The body 304 may be made of any suitable durable material, but for simplicity and to aid in recycling, the body 304 is made of a material similar to that of the toner container 90, for example, the toner container 90 and the body 304 may both be made of polyethylene. Preferably, the container 90 is made of a high density polyethylene and the body 304 is made of a low density polyethylene. The body 304 is matingly fitted into aperture 302 thereby sealing the aperture 302. For example, the body 304 may include a hub 310 which matingly fits with aperture 302.

To provide an area for filter material 320 used to cover the aperture 302 to be protected from abrasion, the body 304 preferably include a recessed area 312 located immediately internal to the hub 310. The recessed area 312 protects the filter media 320. To further assist sealing and provide a stop for the body 304 when installing the cover 300 into the container 90, the body 304 may include a shoulder 314 located on end 316 of the hub 310.

To prevent the escape of toner 92 through opening 306, the cover 300 includes the filter material or shield 320 in alignment with the opening 306. The shield 320 is air permeable and is made of an air permeable media, for example, polyester. Preferably the shield 320 includes glass fibers on the outside of the shield 320. The shield is preferably located on inner surface 322 of the body 304. The shield 320 is preferably larger than the opening 306 so that the inner surface 322 may prevent the shield 320 from escaping through the opening 306. While the opening 306 may be made of a solitary opening 306, the opening 306 may include a plurality of smaller openings spaced about the central part of the body 304. Smaller spaced apart openings may permit the use of a less rigid shield 320.

The air permeable shield or media 320 may be secured to the body 304 in any suitable fashion. For example, the air permeable media 320 may be glued by an adhesive, welded to the body 304, or staked to the body 304. The body 304 may be secured to the aperture 302 in any suitable fashion. For example, the body 304 may be secured in one direction by shoulder 314 and in the opposite direction by a tab 324 located on the hub 310 of the body 304. It should be appreciated, however, that the body 304 may be connected to the container 90 and any other suitable fashion such as by adhesives, or by welding. While the body 304 may be made of any suitable durable material with any suitable shape, applicants have found that a Niagara cap model #417-2 from Niagara Plastics Company, Erie, Pa., is acceptable as the body 304.

By providing a rotatable toner container including internal protrusions which extend substantially along the length of the internal periphery of the toner container, a simple inexpensive toner container may be made with a concise shape.

By providing a toner container with internal protrusions extending the length of the container, substantially all of the toner may be removed from the container by a centrally located auger within the container.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A device for storing a supply of particles for use in a developer unit of an electrophotographic printing machine, the developer unit including a feed mechanism, said device comprising:

an open ended container defining a chamber in communication with the open end thereof with the particles being stored in the chamber of said container, said container defining a longitudinal axis thereof; and a radial protrusion extending inwardly from an internal periphery of said container substantially toward the longitudinal axis of said container, said radial protrusion extending substantially the length of said container, for urging the marking particles in the chamber toward the center of said chamber, said protrusion extending inwardly from the internal periphery of said container so that the free end thereof is in substantial proximity to the feed mechanism such that said protrusion guides the particles directly to the feed mechanism.

2. A device according to claim 1, further comprising:

a puncturable seal attached to the open end of said container for sealing the chamber, said container being installable into the developer unit without removal of said seal.

3. A device according to claim 2, further comprising a removable seal external to said puncturable seal and attached to the open end of said container for sealing the chamber.

4. A device according to claim 2, wherein said puncturable seal comprises a resilient, compressible material.

5. A device according to claim 1, further comprising a second radial protrusion extending inwardly from an internal periphery of said container.

6. A device according to claim 1, wherein said radial protrusion comprises a blade including a substantially planar surface.

7. A device according to claim 1, further comprising a second radial protrusion extending inwardly from an internal periphery of said container opposed to said first mentioned radial protrusion.

8. A device according to claim 1, wherein said protrusion defines a non planar surface thereof.

9. A developer unit for developing a latent image recorded on an image receiving member with a supply of particles, said developer unit comprising:

an open ended container defining a chamber in communication with the open end thereof with the particles being stored in the chamber of said container, said container defining a longitudinal axis thereof, a radial protrusion extending inwardly from an internal periphery of said container substantially toward the longitudinal axis of said container, said radial protrusion extending substantially the length of said container, said radial protrusion for urging the marking particles in the chamber toward the center of said chamber; and feed mechanism extending through the open end into the center of said container for feeding a controllable amount of particles from the chamber of said container, said protrusion extending inwardly from the internal periphery of said container so that the free end thereof is in substantial proximity to said feed mechanism such that said protrusion guides the particles directly to said feed mechanism.

10. A developer unit according to claim 9, wherein said feed mechanism comprises:

a conduit; and an auger closely conforming to said conduit and rotatable therewithin, said conduit including an opening in the upper portion of the periphery thereof for passing particles therethrough from said urging means to said conduit.

11. A developer unit according to claim 10, wherein said urging means comprises a radial protrusion extending inwardly from an internal periphery of said container to a position closely spaced from said conduit.

12. A device according to claim 10, wherein said protrusion and said conduit define a space therebetween of approximately 1.5 millimeters.

13. A developer unit according to claim 9, wherein the opening extends substantially the length of said container.

14. A developer unit according to claim 9, further comprising a second radial protrusion extending inwardly from an internal periphery of said container.

15. A developer unit according to claim 9, wherein said radial protrusion comprises a blade including a substantially planar surface.

16. A developer unit according to claim 9, further comprising a second radial protrusion extending inwardly from an internal periphery of said container opposed to said first mentioned radial protrusion.

17. A device according to claim 9, wherein said protrusion defines a non planar surface thereof.

18. An electrophotographic copy machine for developing with a supply of particles a latent image recorded on an image receiving member, said copy machine including a developer unit comprising:

an open ended container defining a chamber in communication with the open end thereof with the particles being stored in the chamber of said container, said container defining a longitudinal axis thereof, a radial protrusion extending inwardly from an internal periphery of said container substantially toward the longitudinal axis of said container, said radial protrusion extending substantially the length of said container, said radial protrusion for urging the marking particles in the chamber toward the center of said chamber; and a feed mechanism extending through the open end into the center of said container for feeding a controllable amount of particles from the chamber said container, said protrusion extending inwardly from the internal periphery of said container so that the free end thereof is in substantial proximity to said feed mechanism such that said protrusion guides the particles directly to said feed mechanism.

19. A copy machine according to claim 18, wherein said feed mechanism comprises:

a conduit; and an auger closely conforming to said conduit and rotatable therewithin, said conduit including an opening in the upper portion of the periphery thereof for passing particles therethrough from said urging means to said conduit.

20. A copy machine according to claim 18, wherein said urging means comprises a radial protrusion extending inwardly from an internal periphery of said container to a position closely spaced from said conduit.

21. A device according to claim 19 wherein said protrusion and said conduit define a space therebetween of approximately 1.5 millimeters.

22. A copy machine according to claim 18, wherein the opening extends substantially the length of said container.

23. A copy machine according to claim 18, further comprising a second radial protrusion extending inwardly from an internal periphery of said container.

24. A copy machine according to claim 18, wherein said radial protrusion comprises a blade including a substantially planar surface.

25. A copy machine according to claim 18, further comprising a second radial protrusion extending inwardly from an internal periphery of said container opposed to said first mentioned radial protrusion.

26. A device according to claim 18, wherein said protrusion defines a non planar surface thereof.

* * * * *